US007552858B1

(12) United States Patent
Owens

(10) Patent No.: US 7,552,858 B1
(45) Date of Patent: Jun. 30, 2009

(54) MAILBOX FLAG APPARATUS

(76) Inventor: Tony F. Owens, 61 Kelly Rd., Hartwell, GA (US) 30643

( * ) Notice: Subject to any disclaimer, the term of this patent is extended or adjusted under 35 U.S.C. 154(b) by 0 days.

(21) Appl. No.: 12/189,591

(22) Filed: Aug. 11, 2008

(51) Int. Cl.
*A47G 29/14* (2006.01)

(52) U.S. Cl. ..... 232/35

(58) Field of Classification Search ..... 232/35, 232/34, 17; 116/215; D99/29, 31, 43
See application file for complete search history.

(56) References Cited

U.S. PATENT DOCUMENTS

| | | | | | |
|---|---|---|---|---|---|
| 2,730,298 | A | * | 1/1956 | Haserodt | 232/35 |
| 2,852,185 | A | * | 9/1958 | Stouten | 232/35 |
| 3,143,287 | A | * | 8/1964 | Holt | 232/35 |
| 3,338,511 | A | * | 8/1967 | Cvar | 232/35 |
| 3,602,424 | A | | 8/1971 | Raulston | |
| 3,747,839 | A | * | 7/1973 | Morton | 232/35 |
| 3,815,811 | A | * | 6/1974 | Harmon | 232/35 |
| 4,190,193 | A | | 2/1980 | Smith | |
| 4,262,839 | A | | 4/1981 | Wisniewski | |
| 4,365,740 | A | * | 12/1982 | Whitley et al. | 232/35 |
| 4,524,905 | A | * | 6/1985 | Crist | 232/35 |
| 4,738,392 | A | * | 4/1988 | Kovacs | 232/35 |
| 4,756,472 | A | | 7/1988 | Hammons | |
| 4,782,997 | A | * | 11/1988 | Cotton, Jr. | 232/35 |
| 4,798,326 | A | * | 1/1989 | Kirry et al. | 232/34 |
| 4,836,441 | A | * | 6/1989 | Crider | 232/35 |
| 4,986,467 | A | | 1/1991 | Bibbee | |
| 5,004,148 | A | | 4/1991 | Windrem | |
| D478,702 | S | | 8/2003 | Dregney | |
| 7,007,839 | B1 | * | 3/2006 | Piccolo | 232/35 |
| 7,028,883 | B1 | | 4/2006 | Choi | |

* cited by examiner

*Primary Examiner*—William L. Miller
(74) *Attorney, Agent, or Firm*—Crossley Patent Law; Mark A. Crossley

(57) ABSTRACT

The mailbox flag apparatus provides a single unit mechanical combination which requires no modifications to a mailbox. The bracket of the apparatus is made of various materials of choice, which each provide slight flexibility, with memory, such that the bracket is positioned over the finished front edge and on the inside and outside of one side of the mailbox. The mounting force and daily use forces are thereby exposed to a large surface area, which increases mailbox and flag durability and reliability. The critical dimensions of the bracket, flag arm, and pivot location provide automatic gravitational pivotal elevation of the flag arm and flag, upon opening of the mailbox door, thereby signaling a user that a postal stop has occurred.

1 Claim, 4 Drawing Sheets

MAILBOX FLAG APPARATUS

BACKGROUND OF THE INVENTION

Mailbox flags are well known. Automatically positioning the flag of a mailbox in an upward position, after box opening, has been proven desirable in alerting a user of postal delivery. The designs of the devices for automatic flag pivot upon door opening differ greatly, though. Most devices require alteration or modification of a mailbox in order to fit a pivoting flag mechanism. However, it is not desirable to drill holes in a mailbox to mount a pivoting flag device. Further, flag devices which require drilling through the side of a mailbox are prone to loosening and failure. It is further undesirable to affix a pivoting mechanism by encircling a mailbox, especially those which negate full mailbox circumference access. It is also undesirable to propose the use of complexly designed automatically pivoting flag devices, as lack of reliability and production expenses are quite real. What is needed is a mailbox flag which can be positioned in a horizontal position, then provides automatic vertical flag positioning upon mailbox door opening. The present apparatus provides this in a single unit mechanical combination which requires no drilling or any other alteration or modification of a mailbox.

FIELD OF THE INVENTION

The mailbox flag apparatus relates to mailbox flags and more especially to a mailbox flag apparatus which provides automatic upward pivot of the flag when a mailbox door is opened.

SUMMARY OF THE INVENTION

The general purpose of the mailbox flag apparatus, described subsequently in greater detail, is to provide a mailbox flag apparatus which has many novel features that result in an improved mailbox flag apparatus which is not anticipated, rendered obvious, suggested, or even implied by prior art, either alone or in combination thereof.

To attain this, the mailbox flag apparatus is provided in a single unit mechanical combination which requires no modification of the mailbox. The bracket of the apparatus is made of various materials of choice, which each provide slight flexibility, with memory, such the bracket is positioned over the finished front edge and on the inside and outside of one side of the mailbox. The mounting force and daily use forces are thereby exposed to a large surface area, which increases mailbox and apparatus durability and reliability. Further, the finished edge of a high percentage of mailboxes is a strong point, with typically reinforcing rolled edge design. By fitting over the finished edge, this strong point is utilized. The critical dimensions of the bracket, flag arm, and pivot location provide automatic gravitational pivotal elevation of the flag arm and flag, upon opening of the mailbox door, thereby signaling a user that a postal stop has occurred. A complex design and multiple components of prior devices are avoided, without springs and other such components known for failure.

Thus has been broadly outlined the more important features of the improved mailbox flag apparatus so that the detailed description thereof that follows may be better understood and in order that the present contribution to the art may be better appreciated.

An object of the mailbox flag apparatus is to signal the arrival of mail by visual indication of mailbox opening.

Another object of the mailbox flag apparatus is to negate mechanical complexity.

A further object of the mailbox flag apparatus is to provide for sturdy, reliable mailbox mounting.

An added object of the mailbox flag apparatus is to avoid cutting or damaging the mailbox in any way.

And, an object of the mailbox flag apparatus is to provide a single mechanical unit apparatus.

These together with additional objects, features and advantages of the improved mailbox flag apparatus will be readily apparent to those of ordinary skill in the art upon reading the following detailed description of presently preferred, but nonetheless illustrative, embodiments of the improved mailbox flag apparatus when taken in conjunction with the accompanying drawings.

In this respect, before explaining the current embodiments of the improved mailbox flag apparatus in detail, it is to be understood that the mailbox flag apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved mailbox flag apparatus. It is therefore important that the claims be regarded as including such equivalent constructions insofar as they do not depart from the spirit and scope of the mailbox flag apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 8 thereof, the principles and concepts of the mailbox flag apparatus generally designated by the reference number 10 will be described.

Figure 1:
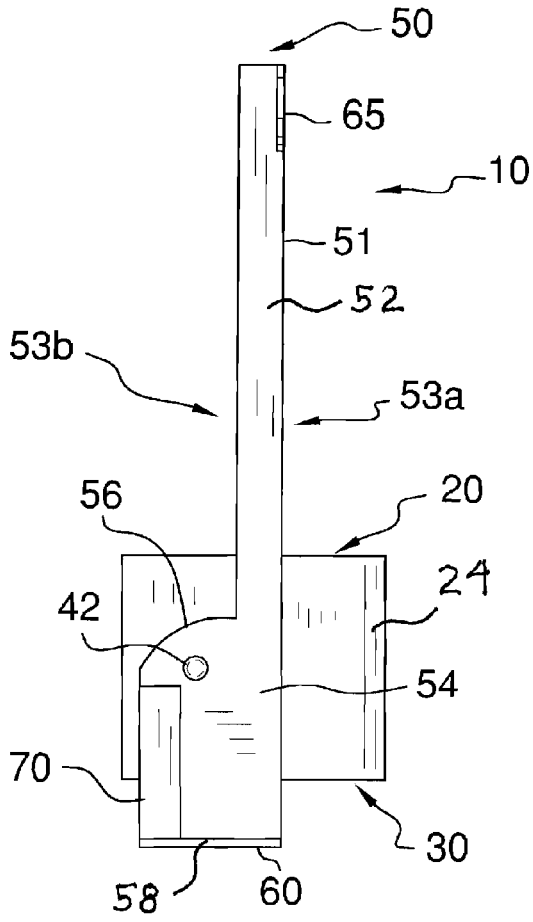
FIG. 1 is a front elevation view.
Figure 2:
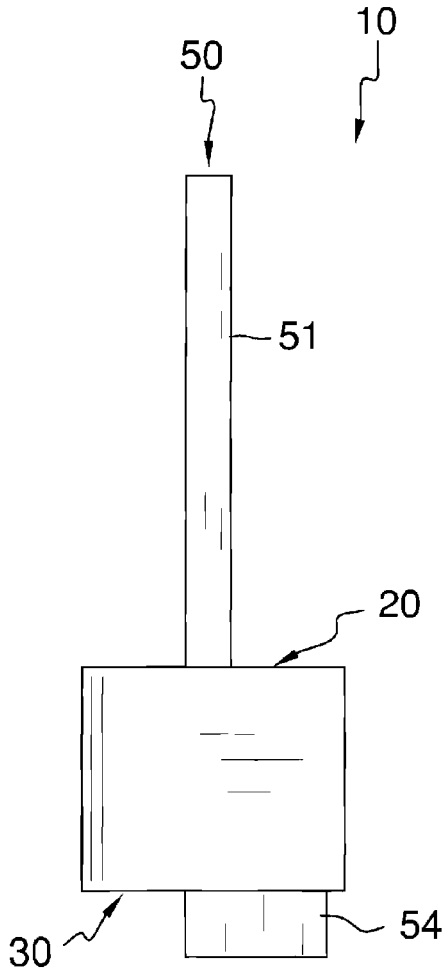
FIG. 2 is a back elevation view.
Figure 3:
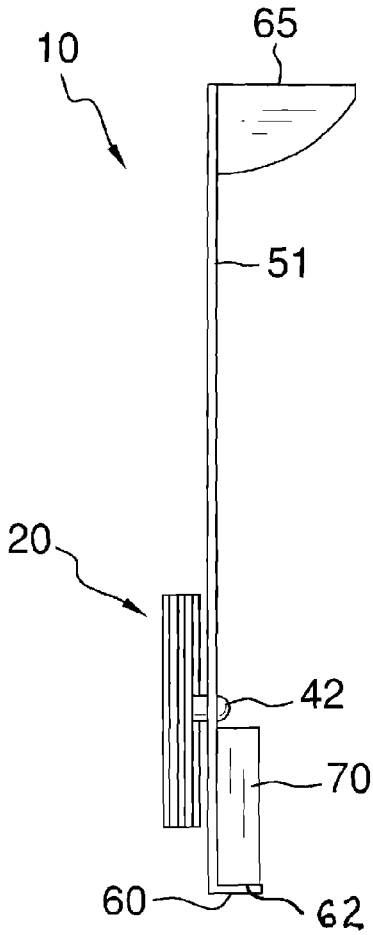
FIG. 3 is a front elevation view.
Figure 4:
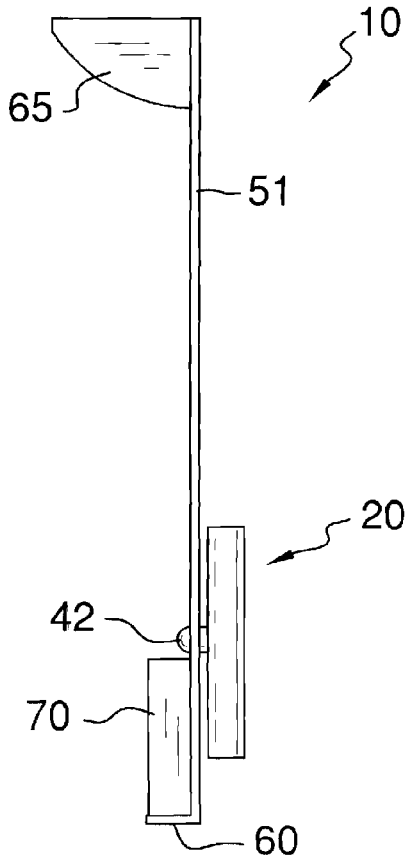
FIG. 4 is a back elevation view.
Figure 5:
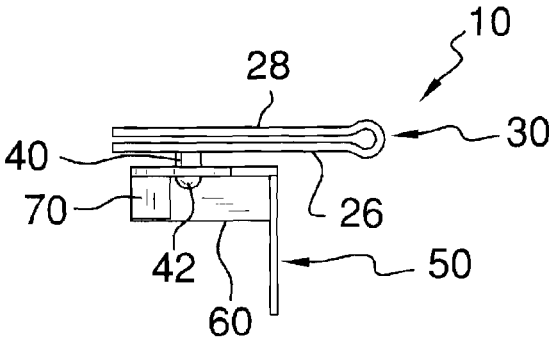
FIG. 5 is a top plan view.
Figure 6:
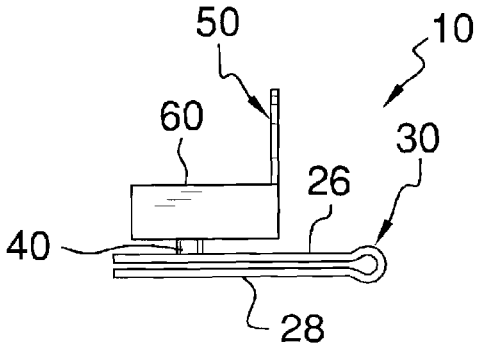
FIG. 6 is a bottom plan view.
Figure 7:
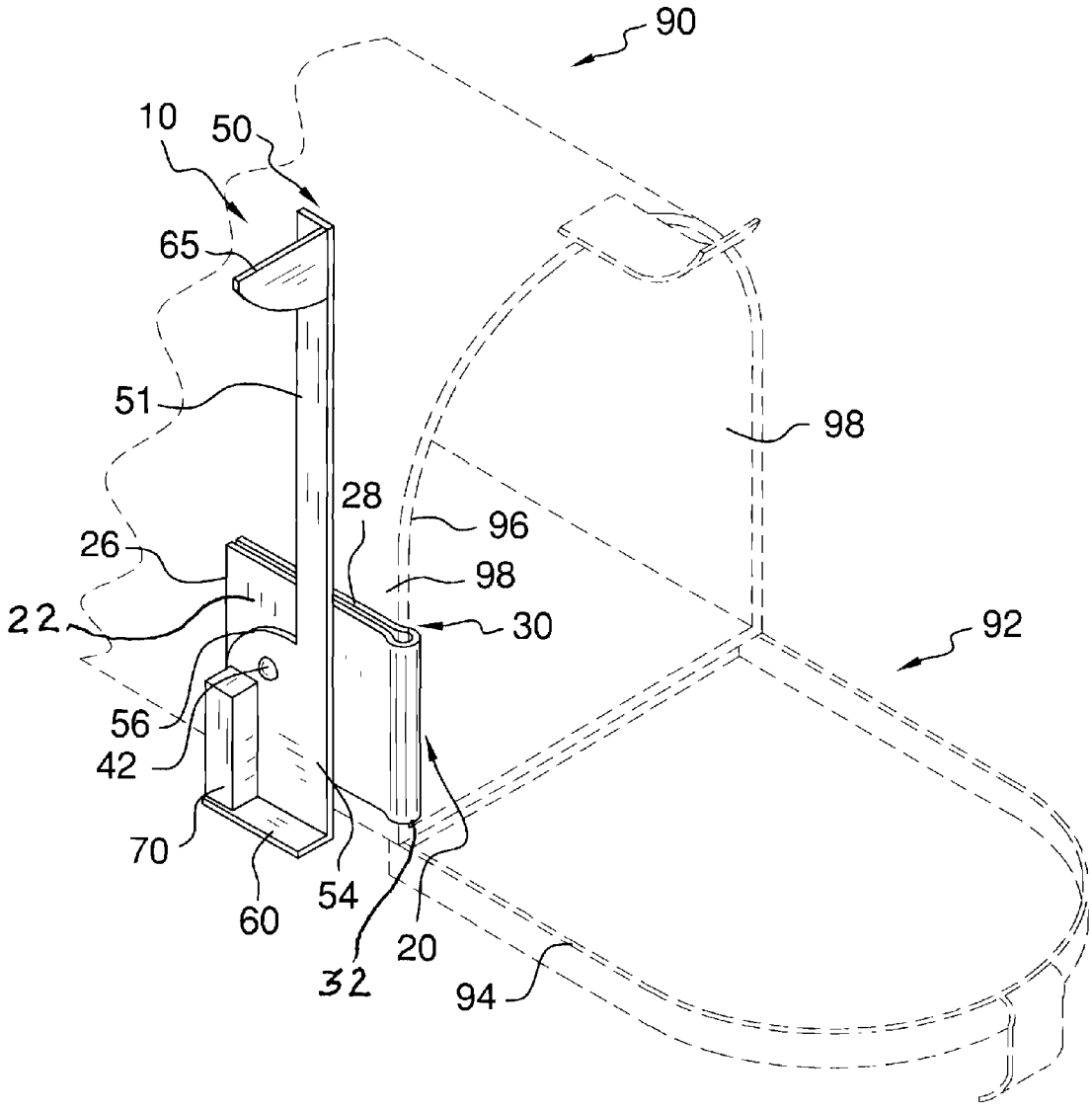
FIG. 7 is a perspective view of the mounted apparatus, mailbox door open, flag up.
Figure 8:
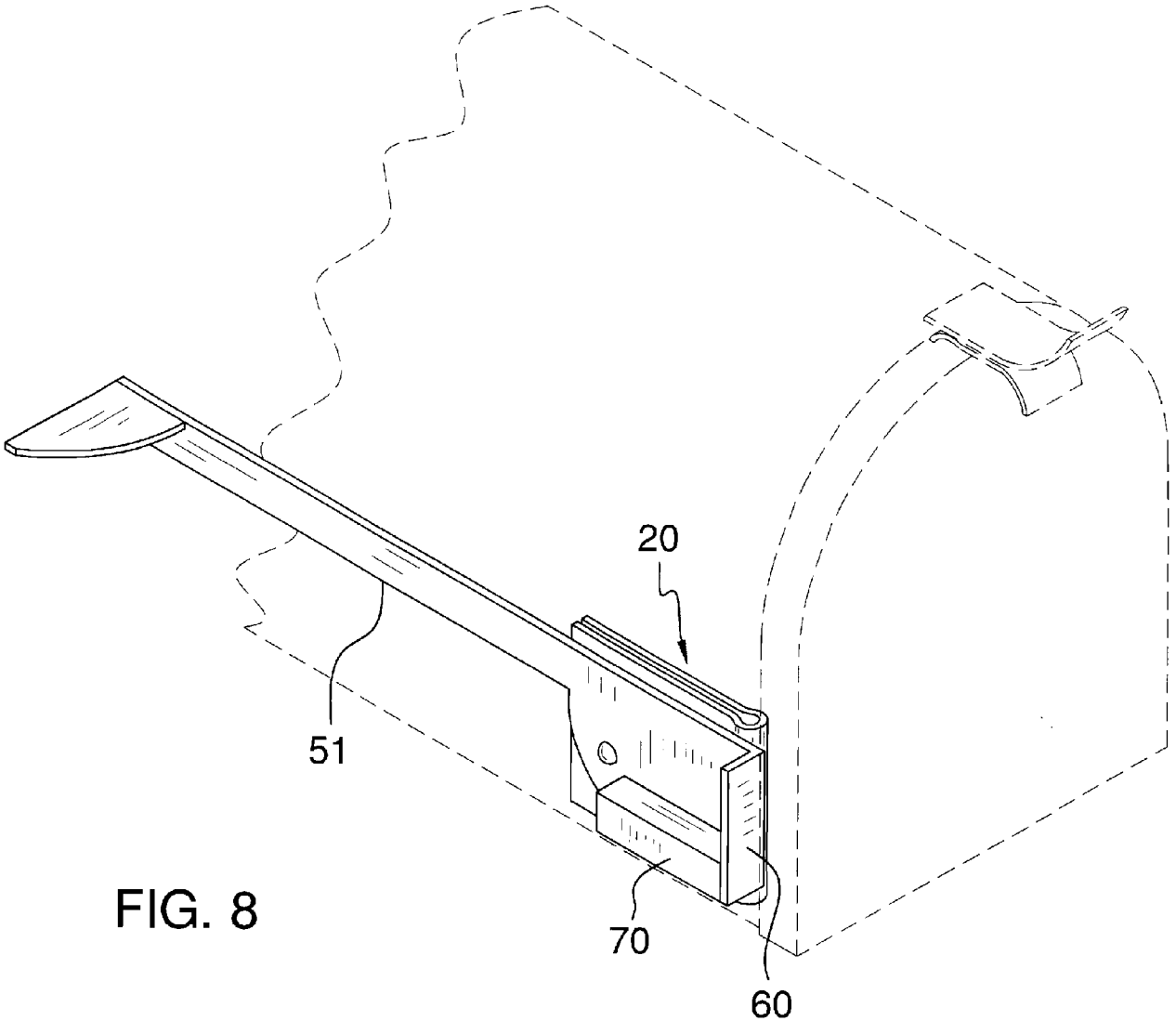
FIG. 8 is a perspective view of the mounted apparatus, mailbox door closed, flag down.

Referring to FIGS. 7 and 8, the mailbox flag apparatus 10 is fitted to an existing mailbox 90. The mount bracket 20 has sufficient flexibility, with memory, to clamp around the box side 98 of the mailbox 90, with the elongated eyelet 30 around the finished edge 96 of the mailbox 90. The bracket 20 is thereby firmly affixed to the box side 98 and finished edge 96 without any alteration or modification to the mailbox 90. The flag arm 50 is selectively positioned horizontally prior to closing of the hinged door 92 of the mailbox 90. The door edge 94 thereby holds the flag arm 50 right angle portion 60 in the horizontal position. Upon opening of the hinged door 92, the flag arm 50 right angle portion 60 loses contact with the door edge 94 such that the flag arm 50 is gravitationally and automatically disposed in the vertical position via the counterweight 70, the pivot 42, and the important dimensions of the flag arm 50, the bracket 20, and the location of the pivot 42.

Referring to FIGS. 1-6 and continuing to refer to FIGS. 7 and 8, the apparatus 10 comprises, in combination, the mount bracket 20 comprising a pair of spaced apart rectangular members comprising a first member 26 and a second member 28. The members are connected by the elongated eyelet 30 of the bracket 20. The bracket 20 has a leading edge 32. The bracket 20 further comprises a bracket width 22 of about 85 millimeters and a bracket height 24 of about 70 millimeters. The bracket 20 is fitted around a finished edge 96 and a partial box side 98 of an existing mailbox 90. The mailbox 90 has a hinged door 92 with a door edge 94. The flag arm 50 has an arm length 52 of about 210 millimeters. The flag arm 50 has a first side 53*a* spaced apart from a second side 53*b*. The flag arm 50 further comprises an arm base 54 having a base width 58 of about 50 millimeters. The flag stalk 51 is affixed atop the base 54. The flag 65 is affixed adjacent to a top of the flag stalk 51. A rounded edge 56 is disposed atop the arm base 54 on the arm 50 second side 53*b*. The right angle portion 60 is disposed on a bottom of the arm base 54. The right angle portion 60 has a angle width 62 of about 10 millimeters. The counterweight 70 is disposed atop the right angle portion 60 adjacent to the arm 50 second side 53*b*. The pivot 42 pivotally affixes the flag arm 50 to the mount bracket 20. The pivot 42 is disposed about 70 millimeters from the leading edge 32 of the mount bracket 20 and about 62 millimeters from the right angle portion 60. The pivot 42 is disposed about 30 millimeters from the arm 50 first side 53*a*. The spacer 40 is disposed on the pivot 42 between the flag arm 50 and the bracket 20 and provides pivotal clearance for the flag arm 50.

With respect to the above description then, it is to be realized that the optimum dimensional relationships for the parts of the mailbox flag apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the mailbox flag apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the mailbox flag apparatus may be used.

Therefore, the foregoing is considered as illustrative only of the principles of the mailbox flag apparatus. Further, since numerous modifications and changes will readily occur to those skilled in the art, it is not desired to limit the mailbox flag apparatus to the exact construction and operation shown and described, and accordingly, all suitable modifications and equivalents may be resorted to, falling within the scope of the mailbox flag apparatus.

What is claimed is:

1. A mailbox flag apparatus, comprising, in combination:

a mount bracket comprising a pair of spaced apart rectangular members comprising a first member and a second member, the members connected by and defining an elongated eyelet, the bracket having a leading edge, the bracket further comprising:

a bracket width of about 85 millimeters;

a bracket height of about 70 millimeters;

the pair of spaced apart rectangular members fitted around a finished edge and a partial box side of a mailbox, the mailbox having a hinged door with a door edge;

a flag arm having an arm length of about 210 millimeters, the flag arm having a first side spaced apart from a second side, the flag arm further comprising:

an arm base having a base width of about 50 millimeters;

a flag stalk affixed atop the base;

a flag affixed adjacent to a top of the flag stalk;

a rounded edge atop the arm base on the arm second side;

a right angle portion on a bottom of and extending orthogonally to the arm base, the right angle portion having a width of about 10 millimeters;

a counterweight atop the right angle portion adjacent to the arm second side;

a pivot pivotally affixing the flag arm to the mount bracket, the pivot disposed about 70 millimeters from the leading edge of the mount bracket and about 62 millimeters from the right angle portion, the pivot disposed about 30 millimeters from the arm first side;

a spacer disposed on the pivot between the flag arm and the bracket;

whereby the right angle portion is disposed in selective contact with the door edge of the door in a closed position such that the flag arm is disposed in a horizontal plane, the flag arm automatically gravitationally moving to a vertical plane after opening the mailbox door.

* * * * *